US008113899B2

(12) United States Patent
Okumura et al.

(10) Patent No.: US 8,113,899 B2
(45) Date of Patent: Feb. 14, 2012

(54) METHOD FOR PRODUCING PLASMA DISPLAY PANEL

(75) Inventors: Tomohiro Okumura, Osaka (JP); Ryuichi Murai, Osaka (JP); Takahiro Takisawa, Osaka (JP); Hiroyoshi Sekiguchi, Osaka (JP); Takayuki Ashida, Osaka (JP); Yoshihiro Sakaguchi, Hyogo (JP)

(73) Assignee: Panasonic Corporation, Osaka (JP)

( * ) Notice: Subject to any disclaimer, the term of this patent is extended or adjusted under 35 U.S.C. 154(b) by 210 days.

(21) Appl. No.: 12/502,369

(22) Filed: Jul. 14, 2009

(65) Prior Publication Data

US 2010/0015877 A1 Jan. 21, 2010

(30) Foreign Application Priority Data

Jul. 18, 2008 (JP) ..... 2008-187404

(51) Int. Cl.
*H01J 9/24* (2006.01)

(52) U.S. Cl. ..... 445/24; 445/25; 313/582

(58) Field of Classification Search ..... 445/24, 445/9, 16, 23, 25, 60; 313/582–587
See application file for complete search history.

(56) References Cited

U.S. PATENT DOCUMENTS

| | | | | |
|---|---|---|---|---|
| 4,427,479 | A * | 1/1984 | Glaser et al. | 156/286 |
| 6,533,630 | B1 | 3/2003 | Terajima et al. | |
| 6,817,917 | B1 | 11/2004 | Kado et al. | |
| 6,984,159 | B1 | 1/2006 | Kado et al. | |
| 2005/0035715 | A1 | 2/2005 | Kado et al. | |
| 2005/0037684 | A1 | 2/2005 | Kado et al. | |
| 2005/0042966 | A1 | 2/2005 | Kado et al. | |
| 2005/0042968 | A1 | 2/2005 | Kado et al. | |
| 2005/0054258 | A1 * | 3/2005 | Kado et al. | 445/60 |

FOREIGN PATENT DOCUMENTS

| | | |
|---|---|---|
| JP | 2000-156160 | 6/2000 |
| JP | 2001-35372 | 2/2001 |
| JP | 2001-222952 | 8/2001 |
| JP | 2002-150938 | 5/2002 |
| JP | 2002-216620 | 8/2002 |
| JP | 2002-231129 | 8/2002 |
| WO | 99/66525 | 12/1999 |

* cited by examiner

*Primary Examiner* — Toan Ton
*Assistant Examiner* — Fatima Farokhrooz
(74) *Attorney, Agent, or Firm* — Wenderoth, Lind & Ponack, L.L.P.

(57) ABSTRACT

A method for producing a plasma display panel, the method comprising the steps of: (i) preparing a front panel and a rear panel, the front panel being a panel wherein an electrode A, a dielectric layer A and a protective layer are formed on a substrate A, and the rear panel being a panel wherein an electrode B, a dielectric layer B, a partition wall and a phosphor layer are formed on a substrate B; (ii) applying a glass frit material onto a peripheral region of the substrate A or B, and then opposing the front and rear panels with each other such that the glass frit material is interposed therebetween; (iii) supplying a gas into a space formed between the opposed front and rear panels from a direction lateral to the opposed front and rear panels, under such a condition that the front and rear panels are heated; and (iv) melting the glass frit material to cause the front and rear panels to be sealed.

11 Claims, 10 Drawing Sheets

(a)

(b)

METHOD FOR PRODUCING PLASMA DISPLAY PANEL

FIELD OF THE INVENTION

The present invention generally relates to a method for producing a plasma display panel. In particular, the present invention relates to the production of the plasma display panel wherein a denatured layer formed on the surface of a protective layer of a front panel is removed.

BACKGROUND OF THE INVENTION

A plasma display panel (hereinafter also referred to as "PDP") is suitable for displaying a high-quality television image on a large screen. Thus, there has been an increasing need for various kinds of display devices using the plasma display panel.

The PDP (for example, 3-electrode surface discharge type PDP) comprises a front panel and a rear panel opposed to each other. The front panel and the rear panel are sealed along their peripheries by a sealing material. Between the front panel and the rear panel, there is formed a discharge space filled with a discharge gas (helium, neon or the like).

The front panel is disposed at the front such as it faces the viewer. The front panel is generally provided with a glass substrate, display electrodes (each of which comprises a scan electrode and a sustain electrode), a dielectric layer and a protective layer. Specifically, (i) on one of principal surfaces of the glass substrate, the display electrodes are formed in a form of stripes; (ii) the dielectric layer is formed on the principal surface of the glass substrate so as to cover the display electrodes; and (iii) the protective layer is formed on the dielectric layer so as to protect the dielectric layer.

The rear panel is generally provided with a glass substrate, address electrodes, a dielectric layer, partition walls and phosphor layers (i.e. red(R), green(G) and blue (B) fluorescent layers). Specifically, (i) on one of principal surfaces of the glass substrate, the address electrodes are formed in a form of stripes; (ii) the dielectric layer is formed on the principal surface of the glass substrate so as to cover the address electrodes; (iii) a plurality of partition walls (i.e. barrier ribs) are formed on the dielectric layer at equal intervals; and (iv) the phosphor layers are formed on the dielectric layer such that each of them is located between the adjacent partition walls. See Japanese Unexamined Patent Publication (Kokai) No. 2002-216620, for example.

In the PDP, the display electrode and the address electrode perpendicularly intersect with each other, and such intersection portion serves as a discharge cell. A plurality of discharge cells are arranged in the form of a matrix. Three discharge cells which have red, green and blue phosphor layers serve as picture elements for color display. In operation of the PDP, ultraviolet rays are generated in the discharge cell upon applying a voltage, and thereby the phosphor layers capable of emitting different visible lights are excited. As a result, the excited phosphor layers respectively emit lights in red, green and blue colors, which will lead to an achievement of a full-color display.

Magnesium oxide (MgO) is commonly used as a component of the protective layer of the PDP. The operating voltage of the PDP depends on the secondary electrons emission coefficient of the protective layer. Accordingly, it has been proposed to decrease the operating voltage by forming the protective layer from an oxide of alkaline earth metal (for example, calcium oxide, strontium oxide, barium oxide, etc.) since such oxide has lower work function. However, the oxides of these alkaline earth metals are highly hygroscopic and may adsorb moisture from the surrounding atmosphere after the protective layer has been formed. This gives rise to such a problem that the surface of the protective layer changes into a hydroxide surface, which results in an unstable discharge characteristic of the PDP.

To address the problem described above, there have been proposed a method whereby the entire process up to sealing after forming the protective layer is performed continuously in a dry atmosphere (see, for example, Japanese Unexamined Patent Publication (Kokai) No. 2002-231129), and a method whereby the entire process up to sealing after forming the protective layer is performed continuously in vacuum (see, for example, Japanese Unexamined Patent Publication (Kokai) No. 2000-156160). These methods are intended to prevent moisture and other impurities from being adsorbed by the protective layer after it has been formed. However, the former (the method whereby the entire process up to sealing after forming the protective layer is performed continuously in a dry atmosphere) has such a problem that some amount of moisture and carbon dioxide do exist in the dry atmosphere which, unless kept sufficiently low in concentration, cause a denatured layer to be formed through exposure thereto over a period of several tens of minutes to several hours. It should be noted that, for example, dry air with a dew point of −20° C. contains 0.1% of moisture, dry air with a dew point of −40° C. contains 0.013% of moisture and dry air with a dew point of −60° C. contains 0.0011% (11 ppm) of moisture. In the process of the PDP production, the work generally stays in process over several hours from the formation process of the protective layer to the sealing process. As a result, a formation of denatured layer may not be avoidable even when the dry air with an extremely low dew point (e.g. dry air with a dew point of −60° C. or lower) is used. The latter (the method whereby the entire process up to sealing after forming the protective layer is performed continuously in vacuum) also has such a problem that a transfer system and a sealing apparatus with very complicated constitutions are required, and thus making the method unpractical. It is also required to keep a large space in vacuum on a constant basis, which will add up to the manufacturing cost.

There has been proposed another method whereby the panels are sealed while cleaning the protective layer that contains the adsorbed impurities therein. This method is intended to remove the impurities in the form of gas from the protective layer. For example, such a method is proposed as, with a first glass tube and a second glass tube provided on the front panel or the rear panel, dry gas is supplied through the second glass tube into the panel while evacuating the inside of the panel through the first glass tube, and thereby reducing the impurities inside of the panel (see Japanese Unexamined Patent Publication (Kokai) No. 2002-150938). However, this method is difficult to implement in practice, because two glass tubes are required and make the constitution of the sealing apparatus very complicated. Even granting that this method could be implemented in a practical system, nonuniformity is produced in the operating voltage of the panel over the panel surface (that is, operating voltage of the panel becomes uneven over the panel surface) because a flow velocity of the dry gas and a concentration of the impurity gas are significantly different between a position near the gas supply glass tube and a position away therefrom. Even when a single glass tube is used to supply the dry gas before sealing and is used to evacuate the gas after sealing, the operating voltage of the panel becomes uneven over the panel surface because a flow velocity of the dry gas and a concentration of the impurity gas are significantly different between a position near the gas supply glass tube and a position away therefrom.

There has been proposed further another method whereby the opposed front panel and the rear panel are set in a heating furnace, and thereby the panels are sealed airtight, and gas is evacuated from the heating furnace while introducing the ambient gas into the furnace (see, for example, Japanese Unexamined Patent Publication (Kokai) No. 2001-35372). However, with this method, significant amount of the dry gas tends to flow outside the panel and thus a large quantity of gas is required. In addition, it is necessary not only to prepare the heating furnace with an airtight vessel structure but also to move the rear panel at a high temperature atmosphere, resulting in a very complicated constitution of the apparatus. The moving of the rear panel at a high temperature may cause misalignment.

As described above, the prior art methods of producing the PDP can have the drawback of being unable to uniformly remove the denatured layer from a surface region of the protective layer at a lower cost.

SUMMARY OF THE INVENTION

Under the above circumstances, the present invention has been created. Thus, an object of the present invention is to provide a simplified method capable of uniformly removing the denatured layer from a surface region of the protective layer at a lower cost.

In order to achieve the object described above, the present invention provides a method for producing a plasma display panel, the method comprising the steps of:

(i) preparing a front panel and a rear panel, the front panel being a panel wherein an electrode A, a dielectric layer A and a protective layer are formed on a substrate A, and the rear panel being a panel wherein an electrode B, a dielectric layer B, a partition wall and a phosphor layer are formed on a substrate B;

(ii) applying a glass frit material onto a peripheral region of the substrate A or B, and then opposing the front and rear panels with each other such that the glass frit material is interposed therebetween;

(iii) supplying a gas into a space formed between the opposed front and rear panels from a direction lateral to the opposed front and rear panels, under such a condition that the front and rear panels are heated; and (iv) melting the glass frit material to cause the front and rear panels to be sealed. It is preferred that a principal surface of each of the front and rear panels is square or rectangular in shape, in which case the gas is supplied wholly from a direction lateral to a side of the opposed front and rear panels, the side corresponding to one side of the square or rectangular surface. It is also preferred that the protective layer is made of at least one kind of metal oxide selected from the group consisting of magnesium oxide, calcium oxide, strontium oxide and barium oxide. Furthermore, it is also preferred that the gas to be supplied has inertness to the protective layer. In this case, the gas to be supplied is preferably at least one kind of gas selected from the group consisting of nitrogen gas, noble gas and dry air.

The present invention is at least characterized in that a gas is supplied into a space formed between the opposed front and rear panels in a lateral direction through a side of the opposed front and rear panels. In other words, according to the present invention, the gas is supplied into the gap space in a direction lateral to the overlapped portion of the front and rear panels.

As used in this specification and claims, the phrase like "gas is supplied from a direction lateral to the opposed front and rear panels" substantially means that the gas is supplied into a space formed between the opposed front and rear panels in a direction substantially perpendicular to the opposed direction of the panels. For example, such phrase means that the gas is fed a space formed between the front and rear panels in the horizontal direction, as shown in FIG. 1. In other words, according to the present invention, the gas is forced to blow into the gap space laterally as a whole.

As used in this specification and claims, the phrase "peripheral region of the substrate A or B" means an edge region outside of a major substrate surface on which various elements are formed. Namely, the phrase "peripheral region of the substrate A or B" substantially means a substrate surface which a conventional PDP production process uses for applying a sealing material.

As used in this specification, the phrase like "removal of denatured layer" substantially means that the adsorbed impurities are removed from the protective layer, and that a hydroxylated or carbonated portion of the protective layer is restored into the original oxide.

In one preferred embodiment, a principal surface of each of the front and rear panels is rectangular in shape, in which case, the gas is supplied wholly from a direction lateral to a side of the opposed front and rear panels, the side corresponding to one longer side of the rectangular surface. In a case where a lead wire of the electrode A or B extends from one side (a) of the opposed front and rear panels, it is preferable to supply the gas from a direction lateral to other side (b) that is opposed to the one side (a).

For supplying the gas in the step (iii), it is preferable to use a gas supply device or a gas nozzle. In this case, the gas supply device or gas nozzle is preferably disposed on the side of the front and the rear panels. In other words, it is preferable to dispose the gas supply device or gas nozzle on the side of the overlapped portion of the front and rear panels. Particularly it is preferable to put the gas supply device into contact with or direct close contact with one of the opposed surfaces of the front and rear panels. In a case of the gas supply device, it is preferable to supply the gas through a plurality of supply ports provided in the gas supply device. This means that the gas is divided into a multitude of fine streams so that the gas is supplied in parallel.

In another preferred embodiment, a glass frit material is provided intermittently in the peripheral region of the substrate A or B in the step (ii) in order to form grooves of the applied glass frit material on the substrate. Alternatively, such grooves are directly formed by partially removing or cutting off the applied glass frit material. The grooves of the applied glass frit material can serve as "tunnels" when the front and the rear panels are opposed to each other, and thereby providing as flow paths for the gas to be supplied.

The step (iv) may be performed at the same time when the step (iii) is performed. In other words, the melting of the glass frit material between the front and rear panels may be performed during the gas supply. In this case, the front and rear panels are sealed at the peripheral regions of the substrates A and B due to the melting of the glass frit material, and thereby automatically or spontaneously ceasing the gas supply into the space formed between the front and rear panels.

In further another preferred embodiment, a metallic foil is provided in at least a part of a space surrounded by the front panel, the rear panel, the gas supply device and the glass frit material. This provision of the metallic gas may be performed in the step (ii), and thereby an efficient gas supply can be achieved in the step (iii).

Subsequent to the step (iv), the present invention additionally may comprise the step (v) of evacuating the space between the front and rear panels and then filling the space with a discharge gas. In this step (v), the evacuation and filling can be performed via a through hole of the front or rear panel.

In accordance with the method of the present invention, the denatured layer can be uniformly and easily removed from the surface of the protective layer at a lower cost, and thereby making it possible to produce the plasma display panel with longer service life.

According to the method of the present invention, the panels are heated in the presence of the gas flow therebetween. Specifically, inert gas (e.g. nitrogen gas) flows between the front and rear panels, particularly near the surface of the protective layer under a heating condition. This causes the denatured layer impurities to be released and entrained into the gas flow. As a result, the denatured layer is removed from the surface of the protective layer, and thus a satisfactory cleanness of the protective layer is achieved.

Due to the gas supply from a direction lateral to the opposed front and rear panels, the gas flow has a higher uniformity over the panel surface. This improves a uniform cleanness of the protective layer over the panel surface. As a result, the obtained PDP can have an improved uniformity in respect of various panel characteristics such as a driving voltage, a brightness and a chromaticity. With a prior art technology disclosed in Japanese Unexamined Patent Publication (Kokai) No. 2002-150938, there is occurred a significant variation over the panel surface in respect of the driving voltage, brightness and chromaticity. The reason for this is that the flow velocity of the dry gas and the concentration of the impurity gas are significantly different between a position near the gas supply tube (i.e. glass tube) and a position away therefrom. Similarly, with such a prior art technology as a single glass tube is used to supply the dry gas before sealing and is used to evacuate the gas after sealing, various panel characteristics such as the driving voltage, the brightness and the chromaticity become uneven over the panel surface since the flow velocity of the dry gas and the concentration of the impurity gas are significantly different between a position near the gas supply tube (i.e. glass tube) and a position away therefrom. In these regards, according to the present invention, the approximate uniformity of the gas flow can be achieved over the panel surface, and thereby a satisfactory uniform cleanness of the protective layer can also be achieved, which will lead to a uniformity of various PDP characteristics such as the driving voltage, the brightness and the chromaticity.

In the prior art case wherein the single glass tube is used to supply the dry gas before sealing and is used to evacuate the gas after sealing, it is necessary to decrease or substantially stop the supplied flow of the nitrogen gas under a temperature condition that is not lower than the softening point of the glass frit material in order to prevent the inner pressure between the two substrates from increasing too high during the gas supply. In other words, this prior art method requires a complex operation of changing the gas flow rate at a precise timing. In this regard, the method of the present invention has such an advantage that the timing of changing the gas flow rate may be rough since the supplied flow of the nitrogen gas automatically or spontaneously decreases as the glass frit material softens and melts.

Moreover, according to the method of the present invention, it is made possible to produce a desired PDP wherein not only the surface region of the protective layer substantially has no moisture, no carbon dioxide or no other impurities adsorbed therein, but also the surface region of the partition wall and phosphor layer of the rear panel has no moisture, no carbon dioxide or no other impurities adsorbed therein. In other words, the produced PDP does not substantially include a gas causing the protective layer to be denatured or degraded (i.e. water or carbon dioxide). As a result, even when the PDP is operated over a long period of time, the protective layer and the phosphor layers is prevented from being denatured since a release of impurity gases (e.g. $H_2O$ and $CO_2$) into the discharge space is suppressed. Accordingly the PDP is less subjected to variation in the discharge voltage and brightness, and thus has a longer service life. The fact that the protective layer has no denatured layer on its surface and the fact that the rear panel does not have the adsorbed gas mean that an aging treatment is substantially unnecessary, or mean that, if required, a very short period of aging suffices.

BRIEF DESCRIPTION OF THE DRAWINGS

FIG. 2(*b*) is a sectional view schematically showing a front panel of PDP.

FIG. 10(*a*) shows the result of the prior art whereas FIG. 10(*b*) shows the result of the present invention.

DESCRIPTION OF REFERENCE NUMERALS

Figure 1:
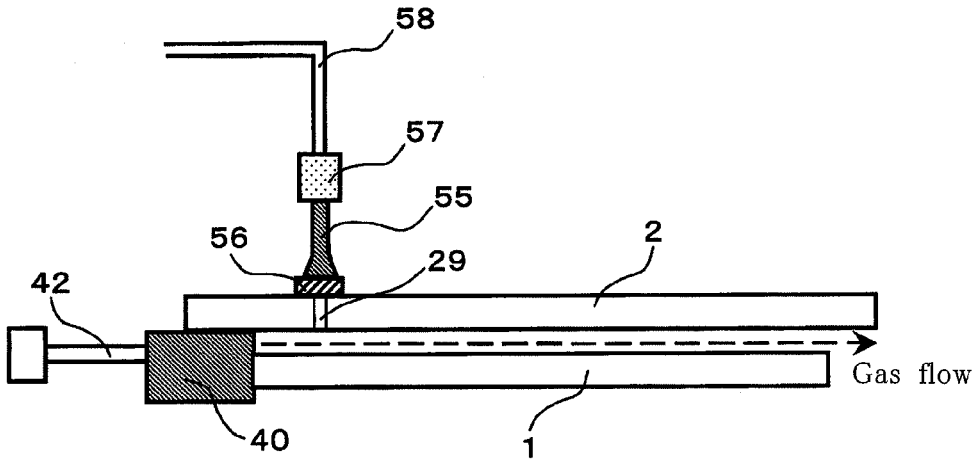
FIG. 1 is a schematic sectional view showing the concept of the present invention.

1 . . . Front panel
2 . . . Rear panel (Back panel)
10 . . . Substrate A of front panel
11 . . . Electrode A of front panel (Display electrode)
12 . . . Scan electrode
12*a* . . . Transparent electrode
12*b* . . . Bus electrode
13 Sustain electrode
13*a* . . . Transparent electrode
13*b* . . . Bus electrode
14 . . . Black stripe (Light shielding layer)
15 . . . Dielectric layer A of front panel
16 . . . Protective layer
20 . . . Substrate B of rear panel
21 . . . Electrode B of rear panel (Address electrode)
22 . . . Dielectric layer B of rear panel
23 . . . Partition wall (Barrier rib)
25 . . . Phosphor layer (Fluorescent layer)

29 . . . Through hole
30 . . . Discharge space
32 . . . Discharge cell
38 . . . glass frit material (which has been applied)
40 . . . Gas supply device
42 . . . Gas supply tube
43 . . . Manifold hollow portion
44 . . . Supply port of gas supply device
55 . . . Tip tube
56 . . . Frit ring
57 . . . Chuck head
58 . . . Piping
60 . . . Metallic foil
61 . . . Groove for gas inlet
62 . . . Groove for gas exhaust
70 . . . Clip
100 . . . PDP

DETAILED DESCRIPTION OF THE PREFERRED EMBODIMENT

Hereinafter, a method for producing a plasma display panel according to the present invention will be described in detail.

[Construction of Plasma Display Panel]

Figure 2:
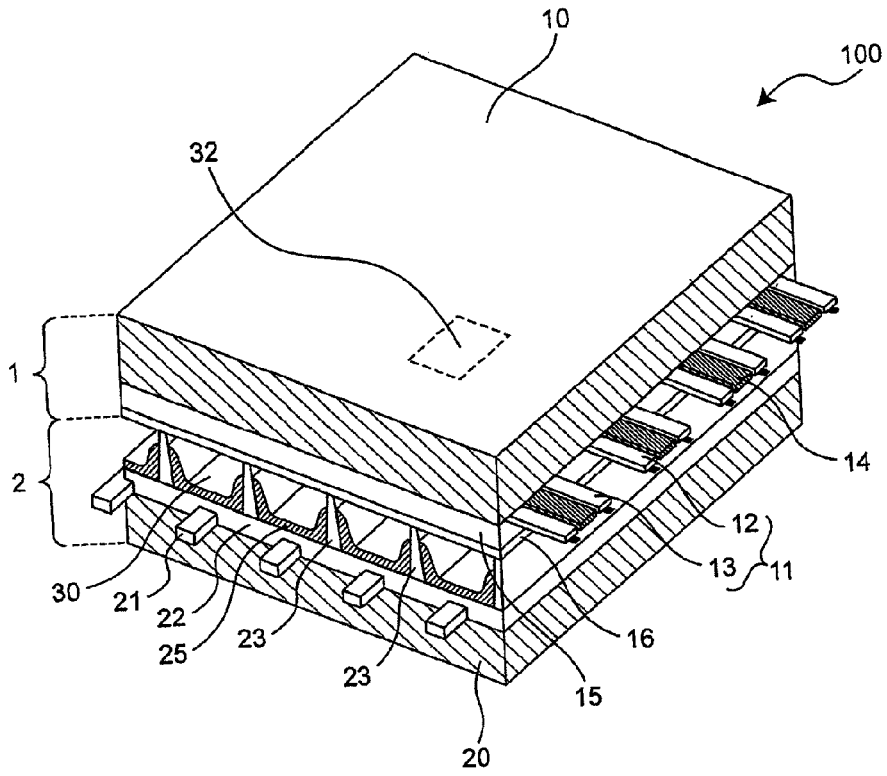
FIG. 2(*a*) is a perspective view schematically showing a structure of PDP.
Figure 2:
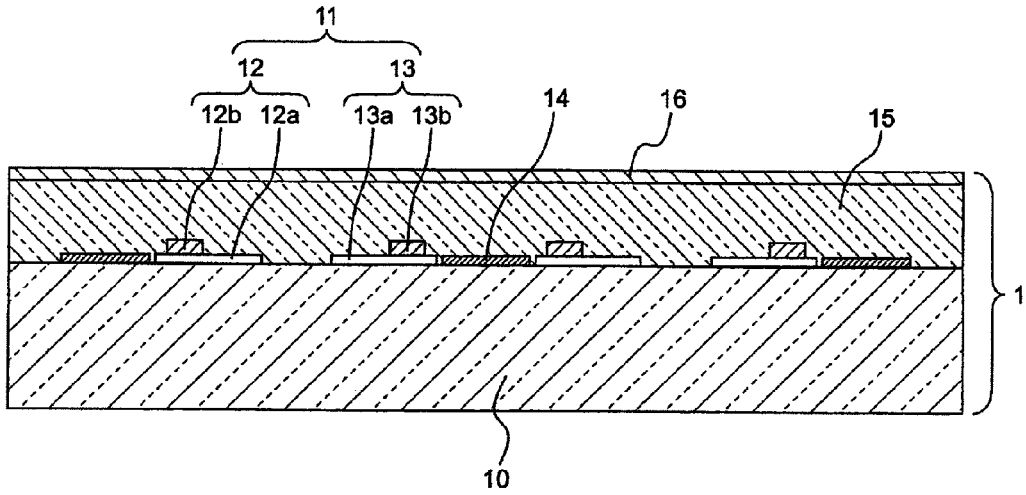

First, a plasma display panel, which can be finally obtained by the method of the present invention, is described below. FIG. 2(*a*) schematically shows a perspective and sectional view of the construction of PDP. FIG. 2(*b*) schematically shows a sectional view of the front panel of the PDP.

As shown in FIG. 2(*a*), the PDP (100) of the present invention comprises a front panel (1) and a rear panel (2) opposed to each other. The front panel (1) is generally provided with a substrate A (10), electrodes A (11), a dielectric layer A (15) and a protective layer (16) The rear panel (2) is generally provided with a substrate B (20), electrodes B (21), a dielectric layer B (22), partition walls (23) and phosphor layers (25).

As for the front panel (1), (i) on one of principal surfaces of the substrate A (10), the electrodes A (11) are formed in a form of stripes; (ii) the dielectric layer A (15) is formed on the principal surface of the substrate A (10) so as to cover the electrodes A (11); and (iii) the protective layer (16) is formed on the dielectric layer A (15) so as to protect the dielectric layer A (15). As for the rear panel (2), (i) on one of principal surfaces of the substrate B (20), the electrodes B (21) are formed in a form of stripes; (ii) the dielectric layer B (22) is formed on the principal surface of the substrate B (20) so as to cover the electrodes B (21); (iii) a plurality of partition walls (23) are formed on the dielectric layer B (22) at equal intervals; and (iv) the phosphor layers (25) are formed on the dielectric layer B (22) such that each of them is located between the adjacent partition walls (23). As illustrated, the front panel (1) and the rear panel (2) are opposed to each other. The opposed front and rear panels are sealed along their peripheries by a sealing material (not shown). As the sealing material, a material consisting mainly of a glass frit with a low melting point may be used. Between the front panel (1) and the rear panel (2), there is formed a discharge space (30) filled with a discharge gas (helium, neon or the like) under a pressure preferably from 20 kPa to 80 kPa.

The PDP (100) of the present invention will be described below in much more detail. As described above, the front panel (1) of the PDP (100) according to the present invention comprises the substrate A (10), the electrodes A (11), the dielectric layer A (15) and the protective layer (16). The substrate A (10) is a transparent substrate with an electrical insulating property. The thickness of the substrate A (10) may be in the range of from about 1.0 mm to about 3 mm. The substrate A (10) may be a float glass substrate produced by a floating process. The substrate A (10) may also be a soda lime glass substrate or a borosilicate glass substrate. A plurality of electrodes A (11) are formed in a pattern of parallel stripes on the substrate A (10). It is preferred that the electrode A (11) is a display electrode which is composed of a scan electrode (12) and a sustain electrode (13). Each of the scan electrode (12) and the sustain electrode (13) is composed of a transparent electrode (12*a*, 13*a*) and a bus electrode (12*b*, 13*b*). The transparent electrode (12*a*, 13*a*) may be an electrically conductive film made of indium oxide (ITO) or tin oxide ($SnO_2$) in which case the visible light generated from the phosphor layer can go through the film. The bus electrode (12*b*, 13*b*) is formed on the transparent electrode (12*a*, 13*a*), and may be mainly made of silver so that it serves to reduce a resistance of the display electrode and give an electrical conductivity in the longitudinal direction for the transparent electrode. Thickness of the transparent electrodes (12*a*, 13*a*) is preferably in the range of from about 50 nm to about 500 nm whereas thickness of the bus electrodes (12*b*, 13*b*) is preferably in the range of from about 1 μm to about 20 μm. As shown in FIG. 2(*a*), black stripes (14) (i.e. light shielding layer) may also be additionally formed on the substrate A (10).

The dielectric layer A (15) is provided to cover the electrodes A (11) on the surface of the substrate A (10). The dielectric layer A (15) may be an oxide film (e.g. silicon oxide film). Such oxide film can be formed by applying a dielectric material paste consisting mainly of a glass component and a vehicle component (i.e. component including a binder resin and an organic solvent), followed by heating the dielectric material paste. On the dielectric layer A (15), there is formed the protective layer (16) whose thickness is for example from about 0.5 μm to about 1.5 μm. The protective layer (16) may be made of magnesium oxide (MgO), and serves to protect the dielectric layer A (15) from a discharge impact (more specifically, from the impact of ion bombardment attributable to the plasma).

As described above, the rear panel (2) of the PDP according to the present invention comprises the substrate B (20), the electrodes B (21), the dielectric layer B (22), the partition walls (23) and the phosphor layers (25). The substrate B (20) is preferably a transparent substrate with an electrical insulating property. The thickness of the substrate B (20) may be in the range of from about 1.0 mm to about 3 mm. The substrate B (20) may be a float glass substrate produced by a floating process. The substrate B (20) may also be a soda lime glass substrate or a borosilicate glass substrate. Furthermore, the substrate B (20) may also be a substrate made of various ceramic materials. A plurality of the electrodes B (21) are formed in a pattern of parallel stripes on the substrate B (20). For example, the electrode B (21) is an address electrode or a data electrode (whose thickness is for example about 1 μm to about 10 μm). The electrodes B (21) serve to cause the discharge to occur selectively in particular discharge cells. The electrodes B (21) can be formed from an electrically conductive paste including silver as a main component.

The dielectric layer B (22) is provided to cover the electrodes B (21) on the surface of the substrate B (20). The dielectric layer B (22) is generally referred to as a base dielectric layer. The dielectric layer B (22) may be an oxide film (e.g. silicon oxide film). Such oxide film can be formed by applying a dielectric material paste consisting mainly of a glass component and a vehicle component (i.e. component including a binder resin and an organic solvent), followed by heating the dielectric material paste. Thickness of the dielectric layer B (22) is preferably in the range of from about 5 μm to about 50 μm. On the dielectric layer B (22), there is formed the phosphor layers (25R, 25G, 25B) whose thickness is for example from about 5 μm to about 20 μm. The phosphor layers (25R, 25G, 25B) serve to convert the ultraviolet ray emitted due to the discharge into visual light ray. The three kinds of the phosphor layer (25R, 25G, 25B) constitute a basic unit wherein three kind of fluorescent material layers, each of which is separated from each other by the partition walls (23), are respectively capable of emitting red, green and blue lights. The partition walls (23) are provided in a form of stripes or in two pairs of perpendicularly intersecting parallel lines on the dielectric layer B (22). The partition walls (23) serve to divide the discharge space into cells, each of which is allocated to one of the address electrodes (21). The partition walls (23) can be made from a paste containing of a glass power, a vehicle component, a filler, etc.

In the PDP (100), the front panel (1) and the rear panel (2) are opposed to each other such that the display electrode (11) of the front panel (1) and the address electrode (21) of the rear panel (2) perpendicularly intersect with each other. Between the front panel (1) and the rear panel (2), there is formed a discharge space (30) filled with a discharge gas. With such a construction of the PDP (100), the discharge space (30) is divided by the partition walls. Each of the divided discharge space (30), at which the display electrode (11) and the address electrode (21) intersect with each other, serves as a discharge cell (32). The discharge gas is caused to discharge by applying a picture signal voltage selectively to the display electrodes from an external drive circuit. The ultraviolet ray generated due to the discharge of the discharge gas can excite the phosphor layers so as to emit visible lights of red, green and blue colors therefrom, which will lead to an achievement of a display of color images or pictures.

[General Method for Production of PDP]

Next, a typical production of the PDP (100) will be briefly described. The PDP associated with the present invention can be basically obtained by the conventional PDP production. In this specification, unless otherwise mentioned, raw materials (i.e. paste material) of the constituent members or parts may be the same as those used in the conventional PDP production.

The typical production of the PDP (100) comprises a step for forming the front panel (1) and a step for forming the rear panel (2). As for the step for forming the front panel (1), not only the display electrode (11) composed of the scan electrode (12) and the sustain electrode (13) but also and the light shielding layer (14) is firstly formed on the glass substrate (10). In the forming of each of the scan electrode (12) and the sustain electrode (13), a transparent electrode (12*a*, 13*a*) and a bus electrode (12*b*, 13*b*) can be formed through a patterning process such as a photolithography wherein an exposure and a developing are carried out. The transparent electrode (12*a*, 13*a*) can be formed by a thin film process. The bus electrode (12*b*, 13*b*) can be formed by drying a silver (Ag)-containing paste at a temperature of about 100 to 200° C., followed by a calcining treatment thereof at a temperature of about 400 to 600° C. The light shielding layer can also be formed in a similar way. Specifically, a light shielding layer precursor can be formed in a desired form by a screen printing process wherein a black pigment-containing paste is printed, or by a photolithography process wherein a black pigment-containing paste is applied over the substrate followed by exposure and developing thereof. The resulting light shielding layer precursor is finally calcined to form the light shielding layer therefrom. After the formation of the display electrode (11) and the light shielding layer (14), the dielectric layer A (15) is formed. Specifically, a layer of dielectric material paste is firstly formed on the substrate A (10) so as to cover the scan electrodes (12), sustain electrodes (13) and the light shielding layer (14). This formation of the paste layer can be performed by applying a paste of dielectric material consisting mainly of a glass component (a material including $SiO_2$, $B_2O_3$, etc.) and a vehicle component with a die coating or printing process. The dielectric material paste that has been applied is left to stand for a predetermined period of time, so that the surface of the dielectric material paste becomes flat. Then the layer of dielectric material paste is calcined to form the dielectric layer A (15) therefrom. After the formation of the dielectric layer A (15), the protective layer (16) is formed on the dielectric layer A (15). The protective layer (16) can be formed by a vacuum deposition process, a CVD process, a sputtering process or the like.

By performing the above steps or operations as described above, the front panel (1) of the PDP can be finally obtained wherein the electrodes A (the scan electrodes (12) and the sustain electrodes (13)), the dielectric layer A (15) and the protective layer (16) are formed on the substrate A (10).

The rear panel (2) is produced as follows. First, a precursor layer for address electrode is formed by screen printing a silver(Ag)-containing paste onto a substrate B (20) (i.e. glass substrate). Alternatively, the precursor layer can be formed by a photolithography process in which a metal film consisting of silver as a main component is formed over the entire surface of the substrate and is subjected to an exposure and development treatments. The resulting precursor layer is then calcined at a predetermined temperature (for example, about 400° C. to about 600° C.), and thereby the address electrodes (21) are formed. The address electrodes (21) may be formed by applying a photoresist onto a 3-layered thin film of chromium/copper/chromium, followed by pattering it with a photolithography and wet etching process. Subsequent to the formation of the electrodes (21), a dielectric layer B (22) (i.e. so-called "base dielectric layer") is formed over the substrate B (20) so as to cover the address electrodes (21). To this end, a dielectric material paste that mainly contains a glass component (e.g. a glass material made of $SiO_2$, $B_2O_3$, or the like) and a vehicle component is applied by a die coating process or the like, so that a dielectric paste layer is formed. The resulting dielectric paste layer is then calcined to form the dielectric layer B (22) therefrom. Subsequently, the partition walls (23) are formed at a predetermined pitch. To this end, a material paste for partition wall is applied onto the dielectric layer B (22) and then patterned in a predetermined form to obtain a partition wall material layer. The partition wall material layer is then heated to form the partition walls therefrom. Specifically, a material paste containing a low melting point glass material, a vehicle component, filler and the like as the main components is applied by a die-coating process or a screen printing process, and then the applied material paste is dried at a temperature of from about 100° C. to 200° C. The dried material is subsequently patterned in a predetermined form by performance of a photolithography process wherein an exposure and a development thereof are carried out. The resulting patterned material is subsequently calcined at a temperature of from about 400° C. to 600° C., and thereby the partition walls are formed therefrom. Alternatively, the partition walls (23) can also be formed by drying a partition wall material film formed by a screen printing, patterning it with an exposure and development of a photosensitive resin-containing dry film, machining the wall material film with a sand blast, peeling off the dry film and finally calcining the wall material film. After the formation of the partition walls (23), the phosphor layer (25) is formed. To this end, a phosphor material paste is applied onto the dielectric layer (22) provided between the adjacent partition walls (23), and subsequently the applied phosphor material paste is calcined. Specifically, the phosphor layer (25) is formed by applying a material paste containing a fluorescent powder, a vehicle component and the like as the main components by performance of a die coating, printing, dispensing or ink-jet process, followed by drying the applied paste at a temperature of about 100° C.

By performing the above steps or operations as described above, the rear panel (2) of the PDP can be finally obtained wherein the electrodes B (the address electrodes 21), the dielectric layer B (22), the partition walls (23) and the phosphor layer (25) are formed on the substrate B (20).

The front panel (1) and the rear panel (2) are disposed to oppose each other such that the display electrode (11) and the address electrode (21) perpendicularly intersect with each other. The front panel (1) and the rear panel (2) are then sealed with each other along their peripheries by the glass frit. The discharge space (30) formed between the front panel (1) and the rear panel (2) is evacuated and is then filled with a discharge gas (e.g. helium, neon or xenon) This results in a completion of the PDP production.

[Method of the Present Invention]

The present invention is characterized by the process up to the panel sealing following the formation of the front and rear panels, among the above production steps or operations of the PDP.

In the method of the present invention, the step (i) is firstly performed. In other words, there is prepared the front panel wherein the electrodes A, the dielectric layer A and the protective layer are formed on the substrate A, and the rear panel wherein the electrodes B, the dielectric layer B, the partition walls and the phosphor layers are formed on the substrate B. The preparation of the front panel and the rear panel has been described above in "General Method for Production of PDP", and thus is omitted here to avoid repetition. Incidentally, the protective layer is typically made of magnesium oxide, but may also include minute quantities of other elements (silicon, aluminum, etc.). More specifically, it is preferred that the protective layer contains at least one kind of oxide selected from the group consisting of magnesium oxide, calcium oxide, strontium oxide and barium oxide. The calcium oxide, strontium oxide or barium oxide of the protective layer makes it possible to not only produce a PDP with lower operating voltage, but also enhance the cleaning effect of the gas supply. Even when an oxide of an alkaline earth element (e.g. calcium oxide, strontium oxide, barium oxide, etc.) with lower work function than that of magnesium oxide is used for the protective layer, a stable discharge characteristics of the PDP can be produced due to the effect of the present invention (i.e. due to the removal of the denatured layer).

Subsequent to the step (i) of the method of the present invention, the step (ii) is performed. Namely, a glass frit material is applied onto the peripheral region of the substrate A or the substrate B, and then the front panel and the rear panel are disposed to oppose each other so as to interpose the glass frit material therebetween. The applied glass frit material serves to seal the peripheries of the front and rear panel substrates in the subsequent sealing step (iv). The glass frit material is preferably applied such that a continuous ring of the glass frit material is formed around the overlapped area of the opposed front and rear panels. There is no restriction on the kind of the glass frit material. Any suitable glass frit material used in the conventional PDP production may be used. For example, a glass frit material consisting mainly of a low melting point glass (such as lead oxide-boron oxide-silicon oxide, lead oxide-boron oxide-silicon oxide-zinc oxide, etc.) may be used. The glass frit material may also include a vehicle component and the like to make it easier to apply on the substrate. The thickness of the applied glass frit material is preferably in the range of from about 200 to 600 μm, and the width thereof is in the range of from about 3 to 10 mm.

Figure 3:
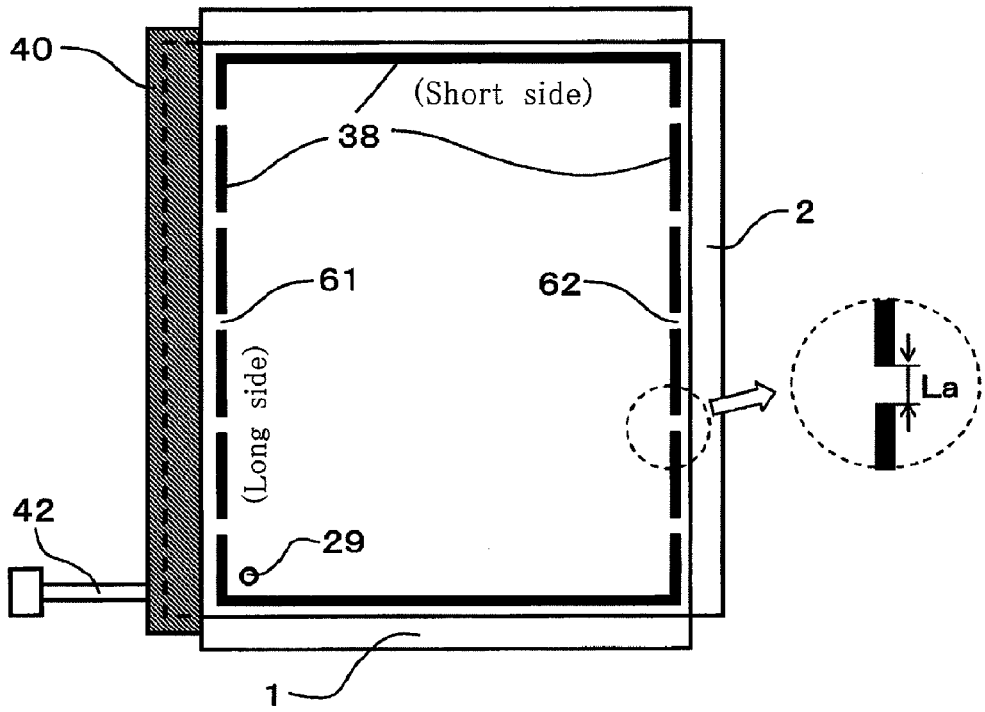
FIG. 3 is a plan view showing an arrangement of the applied glass frit material.

In order to provide a passage for the gas to be supplied in the subsequent step (iii), a plurality of grooves may be formed in the applied glass frit material. Particularly it is preferable to form a plurality of gas inlet grooves (61) and gas exhaust grooves (62) in the applied glass frit material along the longer side of the substrate, as shown in FIG. 3. For a similar reason, the glass frit material may also be applied intermittently to the peripheral region of the substrate A or the substrate B. The length La of the region where there is no glass frit material or length La of the groove as shown in FIG. 3 may depend on each size of the supply ports of the gas supply device, but is roughly in the range of from 0.1 to 5 mm.

Figure 4:
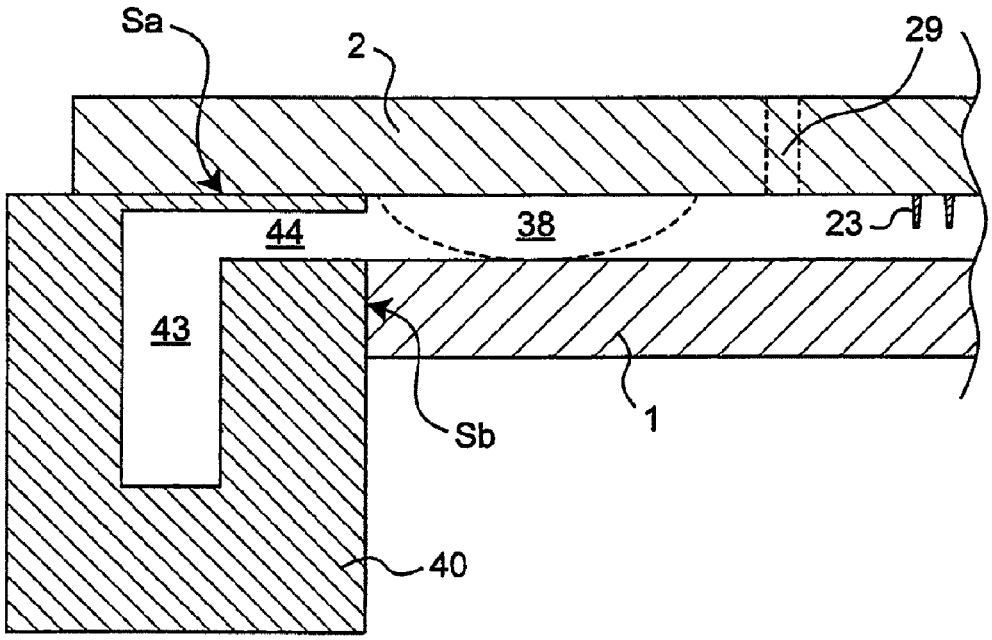
FIG. 4 is a sectional view (taken along line A-A' in FIG. 6) schematically showing an embodiment wherein a gas supply device has been provided.
Figure 7:
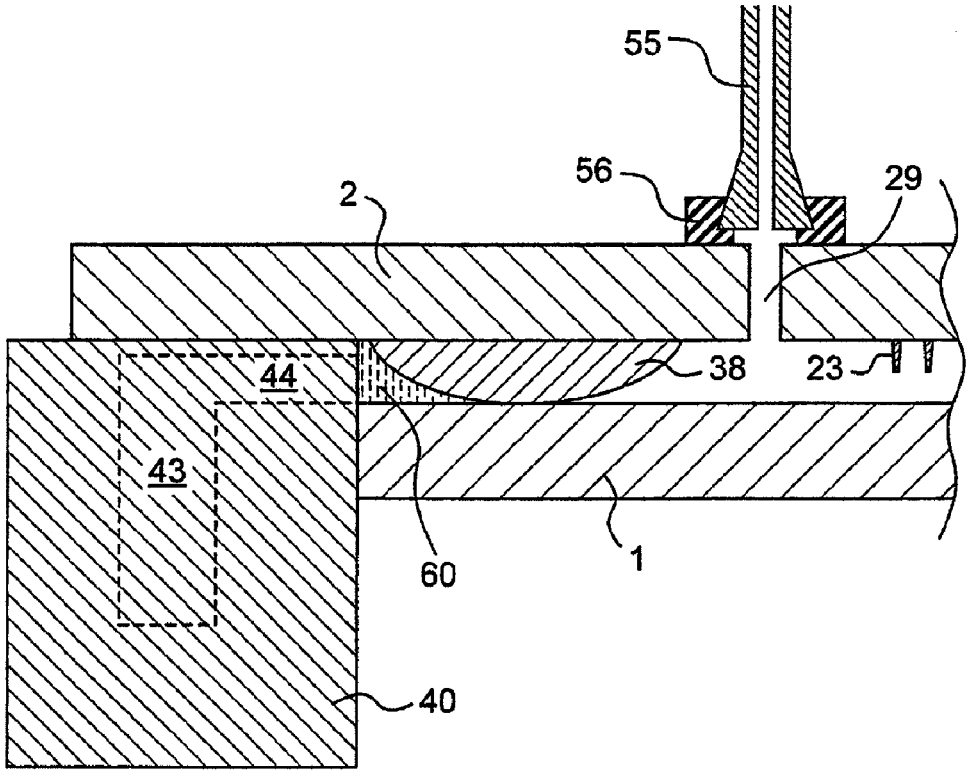
FIG. 7 is a sectional view (taken along line B-B' in FIG. 6) schematically showing an embodiment wherein a metallic foil has been provided.

After applying the glass frit material, the front panel and the rear panel are disposed to oppose each other so that the glass frit material is interposed between the substrate A and the substrate B (see FIG. 4 or FIG. 7, for example). In other words, the front panel and the rear panel are disposed to oppose each other so that the protective layer and the phosphor layer face one another. In particular, the front panel and the rear panel are disposed in parallel to each other so that the display electrodes and the address electrodes cross each other at right angles. It is preferable to hold the opposed front and rear panels with a clip (70) or the like so as not to move them (see FIG. 5). The distance between the opposed front and rear panels (i.e. gap size of the two panels) is preferably in the range of from 100 to 600 μm, more preferably in the range of from 300 to 600 μm, depending on the thickness of the applied glass frit material. In the meantime, while the rear panel (2) has the partition walls (23) formed thereon, the height of the applied glass frit material (38) is higher than that of the partition walls (23) before the sealing process, and thus the tops of the partition walls (23) do not touch the front panel (1), as shown in FIG. 4 or FIG. 7. Upon the gas supply, it is preferable to put the gas supply device into contact with one of the surfaces of the opposed front and rear panels. To this end, it is preferable to offset an edge of the front panel and an edge of the rear panel from each other as shown in FIG. 4. Namely, it is preferred that the front panel edge is not coincident with the rear panel edge in respect of the vertical direction.

Subsequent to the step (ii) of the method of the present invention, the step (iii) is performed. Namely, a gas is supplied into a space formed between the opposed front and rear panels from a direction lateral to the opposed front and rear panels, under such a condition that the front and rear panels are heated. The phrase "gas is supplied into a space formed between the opposed front and rear panels from a direction lateral to the opposed front and rear panels" substantially means that "gas is fed into the gap space between the opposed front and rear panels through the side of the opposed front and rear panels" or "gas is blown into the gap space between the opposed front and rear panels from a direction lateral to a side of the overlapped portion of the opposed front and rear panels".

The heating of the opposed front and rear panels can be performed in a chamber such as furnace. It is preferable to heat the opposed front and rear panels in the furnace while supplying the gas, in which case the gas supply is commenced at a normal temperature. There is no restriction on the heating temperature as long as the denatured layer component (e.g. impurities such as $CO_3^{2-}$ or $OH^-$ that have been contained in the protective layer) can be released from the protective layer. The heating temperature may be in the range of from about 350 to 450° C., for example.

It is preferred that the gas to be supplied has inertness or inactive with respect to the protective layer. As an inert gas, a nitrogen gas may be used. A noble gas such as helium, argon, neon or xenon may also be used. It is also preferred that the gas to be supplied includes very little moisture. For example, it is preferred that the water content of the gas to be supplied is 1 ppm or less. As used herein, "water content of the gas (ppm)" means the proportion of water or water vapor in the total volume of the gas (standard condition of 1 atmosphere at 0° C.) in terms of part per million, and represents a value measured by a conventional dew point meter. Since the nitrogen gas is expensive, the use of dry air makes the PDP production more cost effective. While the optimum flow rate of the gas depends on the size of the gas supply device, panel size, number and width of the gas inlet grooves (61) and gas exhaust grooves (62), each size of the gas supply ports (44), thickness and surface irregularity of the applied glass frit material and other factors, it is roughly in the range of from 1 SLM to 100 SLM (SLM is a unit for expressing a volume (L) of the supplied gas per one minute in the standard condition). The insufficient flow rate of the gas may allow the outside air to intrude or an insufficient cleaning to occur, whereas the excessive flow rate of the gas may be disadvantageous in terms of cost.

Figure 5:
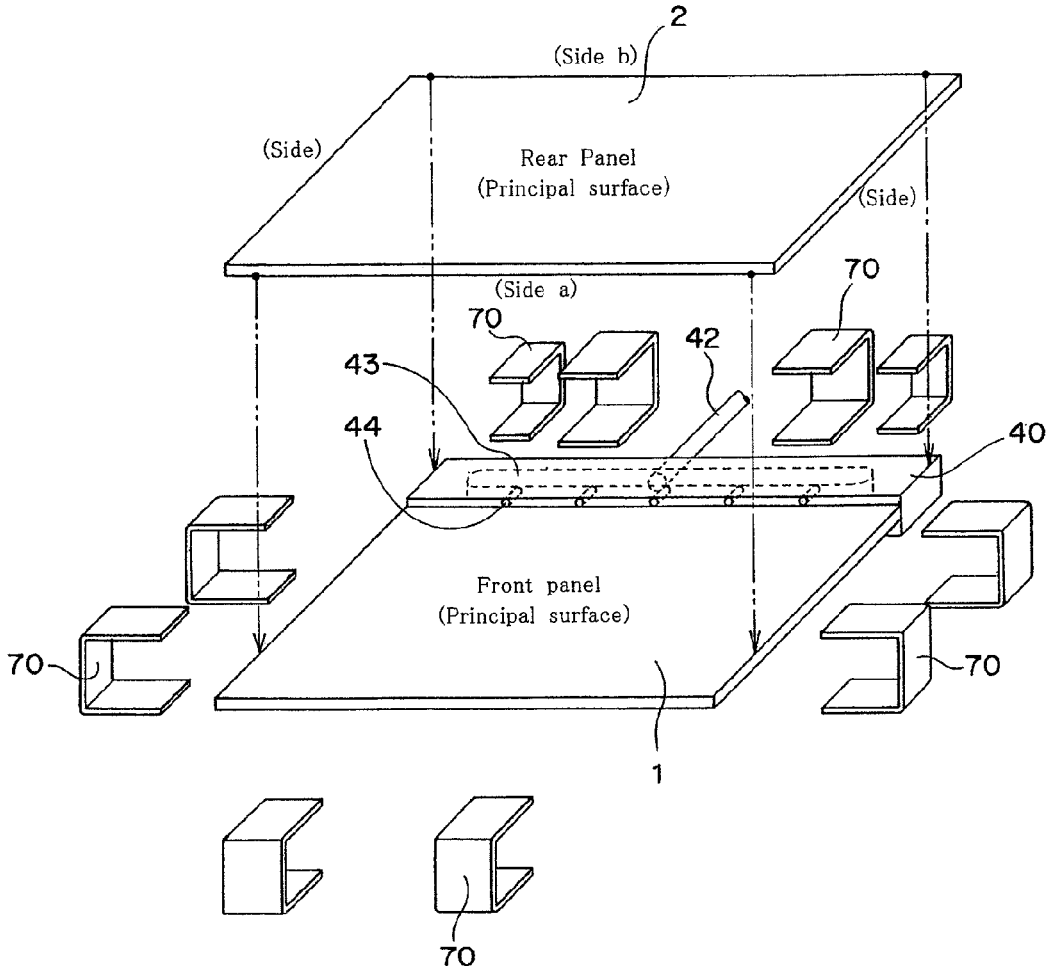
FIG. 5 is an exploded perspective view schematically showing an embodiment wherein a gas supply device is provided.

For supplying the gas into the space formed between the opposed front and rear panels, it is preferable to use a gas supply device (40) as shown in FIG. 5. The gas supply device (40) is connected to a gas supply tube (42), and the gas supply tube (42) is connected to a gas supply apparatus (not shown) comprising a pump and other components. As a result, the gas can be supplied via the gas supply device (40). It is preferred that the gas supply device (40) is put into contact with the peripheral portion Sa of the principal surface of the rear panel (2) and also contact with the side face Sb of the front panel (1), as shown in FIG. 4. The gas supply device may be secured or fastened by means of a clip as required. The use of the clip can effectively prevent the gas from flowing away to the outside of the opposed front and rear panels. It is preferred that the gas supply device is made of a metal with a thermal expansion coefficient close to that of the glass substrate, in which case there is prevented an occurrence of dust and displacement attributable to the abrasion between the gas supply device and the substrate when heated. The linear expansion coefficient of a typical glass substrate for PDP (i.e. substrate A or B) is 8.3E-6/K (PP-8 manufactured by Nippon Denki Glass at 30 to 380° C.). Accordingly, as a material for the gas supply device, it is preferable to use a material with a linear expansion coefficient of from 4.2E-6 to 1.7E-5/K, which are approximately in the range of from one half to two times of 8.3E-6/K. Example of metallic materials with thermal expansion coefficient close to that of the PDP glass substrate include titanium (pure titanium 8.6E-6/K, titanium alloy Ti-6A1-4V: 8.8E-6/K) and kovar (4.6E-6/K).

Figure 6:
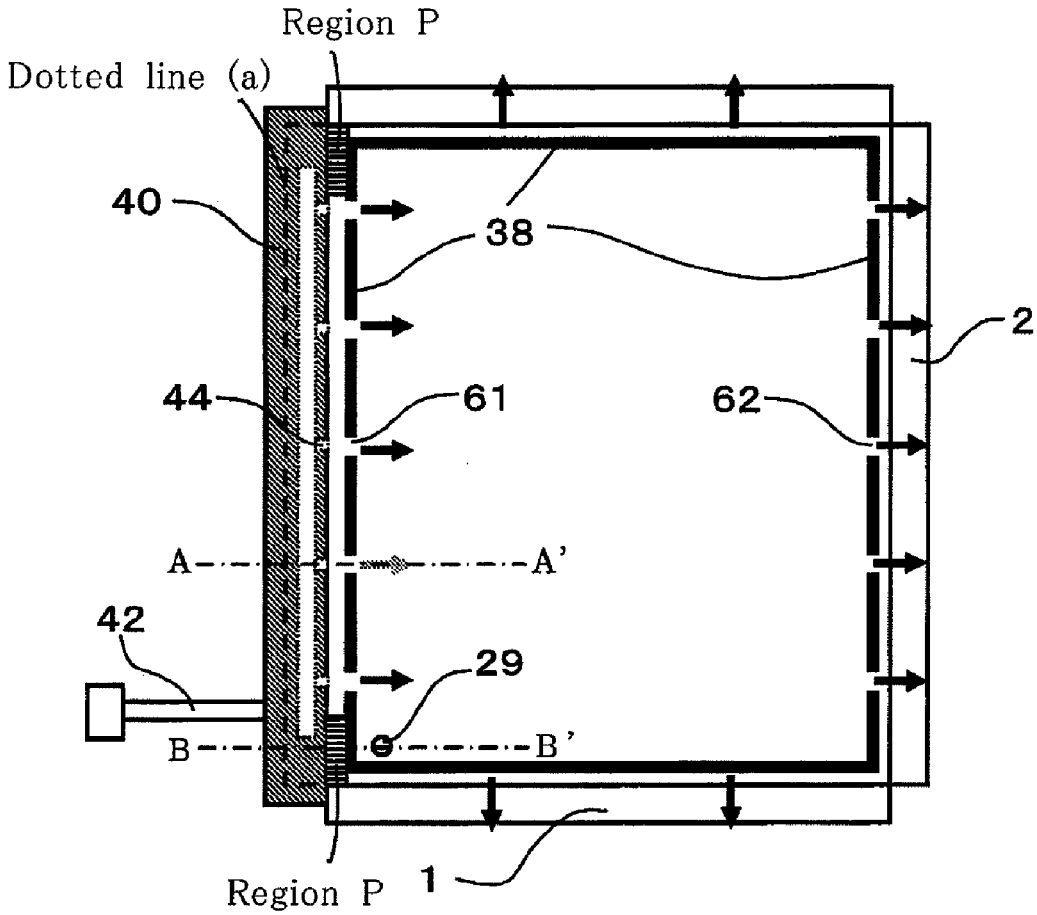
FIG. 6 is a plan view schematically showing gas supply ports and gas streams (wherein the dotted line (a) indicates an edge of a rear panel).

As shown in FIG. 4 and FIG. 5, it is preferred that the gas supply device (40) has a hollow portion (43) and a plurality of supply ports (44) connected in fluid communication therewith. The hollow portion (43) serves as a manifold in the gas supply device (40). The use of the gas supply device (40) with hollow portion (43) and supply ports (44) makes it possible to divide the gas into parallel streams. This will promote the gas to be supplied wholly from a side of the opposed front and rear panels, the side corresponding to one side of the square or rectangular surface of each panel. It is preferred that the gas supply device (40) is brought into contact with one of the facing surfaces of the opposed front and rear panels (for example, the inner surface Sa of the rear panel (2) shown in FIG. 4) so that the longitudinal length of the hollow portion (43) is aligned along the longer side of the rear panel (2). The gas supply device (40) is also disposed so that the outlets of the supply ports (44) face toward the inside of the panel as shown in FIG. 5 or FIG. 6. It is preferable to arrange the supply ports (44) of the gas supply device in accordance to the positions of the gas inlet grooves (61), as shown in FIG. 6. As illustrated, the gas supplied through the supply ports (44) in the direction of right arrow shown in FIG. 6 can flow through the gas inlet groove (61) of the glass frit (38) into the gap space between the front and rear panels. The gas that has supplied into the space formed between the opposed front and rear panels is finally discharged therefrom. Specifically, the supplied gas is finally discharged through the gas exhaust groove (62). In this regard, even if there is provided no groove (62) in the glass frit (38), the supplied gas can be discharge from the space between the front panel and the rear panel. The reason for this is that the top surface of the glass frit material (38) between the opposed front and rear panels is not exactly flat and has irregularities measuring about several tens to a hundred micrometers even though such top surface is in contact with the front panel (1). Accordingly, the gas can be discharged through the gaps between the glass frit material (38) and the front panel (1). See the vertical arrows shown in FIG. 6. It should be noted that the gas supply apparatus and the exhaust apparatus that are connected to the tip tube are shut off by means of valves so that they are not operated.

In a case where the gas exhaust groove (62) is provided as shown in FIG. 6, a volume of the gas discharged through no grooved portion as indicated by vertical arrows is very small. As a result, the gas can flow mostly in one direction between the opposed front and rear panels, and thus a more uniform removal of the denatured layer is achieved.

It is preferable to supply the gas through the longer side of the opposed front and rear panels. To this end, the gas supply device (40) is provided on the longer side of the principal surface of the front panel or the rear panel. The gas supply through the longer side makes it possible to decrease the length of the gas streamline between the opposed front and rear panels than a case of the gas supply through the shorter side, which will lead to an achievement of more uniform removal of the denatured layer. Since a lead wire of the address electrode may extend from one of the longer sides, it is preferable to supply the gas from the other longer side where there is no lead wire. This means that the gas supply device is prevented from touching the electrodes. As a result, there is prevented a dust attributable to the abrasion of the electrode material, which will lead to a prevention of a breakage of the electrode and a short-circuiting of the adjacent electrodes and a lighting failure of the panel. Assuming that the gas supply device (40) is put into contact with the longer side where the lead wires of the electrodes extend, then there is formed a gap with the size of the electrode thickness between the gas supply device (40) and the rear panel (2), thus requiring a more flow rate of the supplied gas. In contrast, the disposing the gas supply device (40) into contact with the longer side where no lead wire of the electrodes extend enables it to decrease the flow rate of the supplied gas, thus contributing to the cost reduction.

Subsequent to the step (iii) of the method of the present invention, the step (iv) is performed. Namely, the glass frit material is melted so that the opposed front and rear panels are sealed. As the glass frit is heated to melt, the front panel and the rear panel are bonded with each other airtight along their peripheries by the melted glass frit. There is no restriction on the heating temperature of the step (iv) as long as the melting of the glass frit can be performed. In other words, the heating temperature of the step (iv) may be "sealing temperature" commonly employed in the conventional PDP production process, for example, a temperature ranging from about 400 to 500° C. Upon performing the gas supply step (iii), the sealing step (iv) may also be performed. Detailed description will be given with this regard. The gas supply is commenced at a normal temperature. The opposed front panel and the rear panel are heated in a furnace during the gas supply. When the temperature exceeds the softening point of the glass frit, the glass frit then softens and fills the gap formed between the frit and the front panel. In this case, the gas inlet grooves (61) and the gas exhaust grooves (62) are also filled with the softened frit since they are formed with sufficiently small width (for example, each groove has width being one half or less of the glass frit width). The opposed front and rear panels are held in a temperature range in which the glass frit (38) are completely melted for several minutes to ten several minutes, followed by a cooling treatment thereof to harden the glass frit and thereby sealing the front panel and the rear panel with each other. Subsequent to the sealing step, the space between the front and rear panels is evacuated while holding the sealed front and rear panels at a little lower temperature than the sealing temperature so as to kept the glass frit in the solidified state. Through this process, the gas supplied from the gas supply device (40) finally cannot flow into the space between the front and rear panels due to the presence of the melted glass frit in the temperature range where the glass frit is completely melted, and thus ceasing the substantial gas supply into the space formed between the front and rear panels. This results in an achievement of minimum gas consumption.

Performing the gas supply step (iii) and the sealing step (iv) after the step (ii) of opposing the front and rear panels means that the heating is conducted under the condition that the top of the glass frit is in contact with the front panel after the alignment. Accordingly, a disalignment during the sealing process is less likely to occur in the PDP production according to the present invention, which will lead to an achievement of a high reliability in the PDP production.

After sealing the front panel and the rear panel together, the space formed between the front and rear panels is evacuated and is filled with a discharge gas. As the discharge gas, a mixture of Xe and Ne may be used. Xe only, or a mixture of Xe and He may also be used. The evacuation of the space and filling it with the discharge gas are preferably carried out by using a through hole of the front panel or the rear panel. FIG. 7 shows a through hole (29) formed in the rear panel. The through hole may have any shape, form and size as long as it enables to evacuate the space formed between the opposed front and rear panels and supply the discharge gas. Just as example, the through hole may be round through hole with diameter of about 1 to 5 mm. While it is necessary to provide the through hole at a position located inward from the region where the glass frit material is applied, it is preferable to provide the through hole in the peripheral portion of the front panel or the rear panel outside of the PDP display section, so as not to impair an image display of the PDP. The through hole may be formed by an appropriate process such as a drilling or laser machining process of the prepared front or rear panel. In a case where the through hole is provided in the rear panel, it is preferable to form the through hole after the phosphor material paste is applied and dried.

The through hole will be described in more detail below. As shown in FIG. 1, the tip tube (55) is provided above the through hole (29) via a frit ring (56). The tip tube (55) is connected, at the end thereof, with a chuck head (57) that constitutes an end of the pipe (58). The chuck head (57) has a water-cooled pipe and a sealing mechanism (not shown) so as to maintain the system airtight even when the tip tube (55) and the pipe (58) are heated up to the sealing temperature. The gas supply apparatus and the exhaust apparatus (not shown) are connected to the pipe (58). As a result, via the through hole, the gas can be purged or exhausted from the space between the opposed front and rear panels and also the discharge gas can be supplied to the space.

It should be noted that the through hole is substantially closed during the gas supply step (iii) of method of the present invention. More specifically, while the tip tube (55) is pressed against the rear panel (2) in alignment with the through hole (29) via the frit ring (56), the surfaces whereon the tip tube (55) and the frit ring (56) make contact with each other and the surfaces whereon the frit ring (56) and the rear panel (2) make contact with each other are flat and smooth, and therefore there occurs substantially no leakage of gas through these surfaces. Also there occurs substantially no leakage of gas through the tip tube (55) since the gas is supplied while the valve located nearest to the tip tube (55), among valves provided on the pipe (58) communicated with the tip tube (55), is closed.

As for the present invention, various modifications may be made so as to effectively supply the gas. For example, "stuffing material" or "filling material" may be used to guide more of the gas supplied from the gas supply device into the space formed between the opposed front and rear panels. For example, it is preferable to provide a metallic foil (60) in at least a part of the space surrounded by the front panel (1), the rear panel (2), the gas supply device (40) and the glass frit material (38) at positions near the ends of the gas supply device (40) in the longitudinal direction, as shown in FIG. 7. In other words, it is preferable to fill the gap of the region P shown in FIG. 6 with the metallic foil. The presence of the metallic foil (60) can reduce the leakage of the gas during the gas supply step (iii). Without the metallic foil (60), a part of the gas supplied from the gas supply device (40) may escape to the outside without entering the space formed between the front and rear panels. According to the present invention, such escaped gas can be effectively suppressed by the metallic foil (60). The use of the metallic foil (60) as the stuffing material makes it possible to reduce the gas consumption and remove the denatured layer from the protective layer at a lower cost. As the metallic foil (60), aluminum foil with a thickness of several tens of micrometers may be used, for example. The aluminum foil cut to a size of several millimeters to several centimeters square may be crumpled and squeezed into the space surrounded by the front panel (1), the rear panel (2), the gas supply device (40) and the glass frit material (38). In this case, it is not necessary to completely fill the space, and it suffices to decrease the space through which the gas passes to the outside. As the front panel (1) and the rear panel (2) are heated in the furnace to melt the glass frit (38) and seal the panels while supplying the gas, the gap formed between the opposed front and rear panels (1) and (2) gradually decreases. In this process, the crumpled aluminum foil is not so strong as to prevent the gap from decreasing, and thus can gradually deform according to the gap changes. Therefore, with the use of aluminum foil, there is substantially no possibility of the gap deviating from the design value when the PDP is completed. The stuffing material is required, in addition to the capability to easily deform in accordance to the gap changing, (a) to be less likely to release impurity gas that contaminates the protective layer even when heated to the sealing temperature (about 400 to 500° C.), and (b) to not fuse with the gas supply device when heated to the sealing temperature. In this regard, the metallic foil satisfies these requirements.

Figure 8:
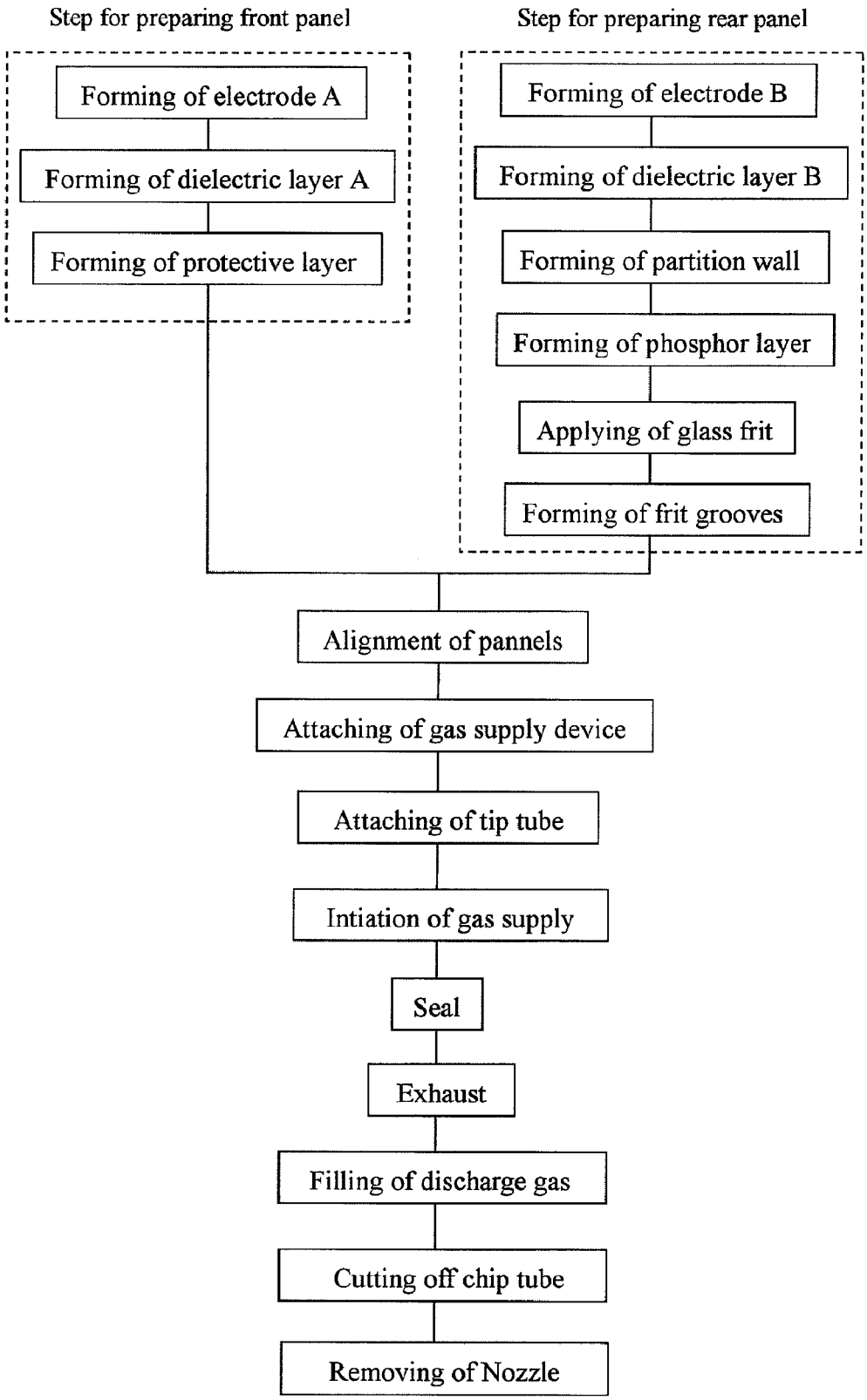
FIG. 8 is a flowchart of operations associated with a method for producing a plasma display panel according to the present invention.

With reference to FIG. 8, the procedure of operation will now be described serially. FIG. 8 is a flow chart schematically showing the procedure of operation according to the PDP method of the present invention. Firstly, the front panel and the rear panel are prepared. The prepared front and rear panels are aligned in an alignment apparatus, and thereafter they are opposed to each other via the glass frit material. The opposed front and rear panels are held in place. Subsequently, the gas supply device is attached to a side portion of the opposed front and rear panel so that the gas from the device is supplied sideways into the space formed between the panels. The tip tube is also attached to the rear panel in alignment with the through hole. During the time period from the formation of the protective layer to the attachment of the device and tube, the protective layer is exposed to the ambient air, and thus the denatured layer may be formed on the surface of the protective layer. Subsequently, a gas (e.g. nitrogen gas) is supplied from the gas supply device into the space formed between the front and rear panels. The opposed front and rear panels are heated in a furnace while supplying the gas, and thereby the glass frit is melted. As a result, the front and rear panels are seal together. After the sealing step, the space formed between the front and rear panels is evacuated by exhausting the gas through the tip tube, while holding the front and rear panels at a temperature that is a little lower than the sealing temperature so as to solidify the glass frit. Subsequently, the front panel and the rear panel are cooled down to around the normal temperature. Thereafter, the discharge gas is introduced into the space formed between the front panel and the rear panel so that the predetermined internal pressure is produced. Finally, by cutting off the tip tube from the panel, the PDP can be obtained.

Although the present invention have been described above, those skilled in the art will understand that the present invention is not limited to the above, and various modifications may be made.

Figure 9:
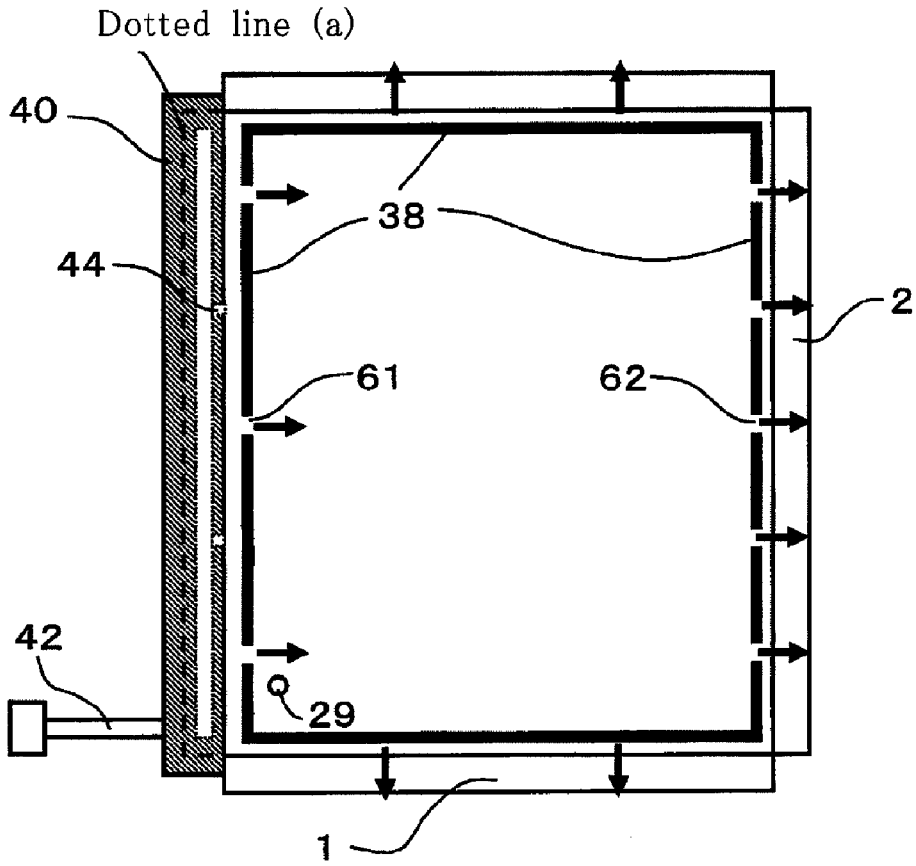
FIG. 9 is a plan view schematically showing a staggered arrangement of gas supply ports and gas inlet grooves (wherein the dotted line (a) indicates an edge of a rear panel).

The embodiment wherein the gas supply ports are provided in alignment with the gas inlet grooves has been described above (see FIG. 6), but the present invention is not limited to that. For example, the gas supply ports (44) may also be provided at positions offset from the gas inlet grooves (61) as shown in FIG. 9. In this case, the space surrounded by the front panel (1), the rear panel (2), the gas supply device (40) and the glass frit material (38) may serve as a second manifold.

While the gas supply is preferably commenced at the normal temperature as described above, the gas supply may also be performed in such a temperature range that is effective for removing the denatured layer. This can results in a decrease of the gas consumption.

Moreover, the frit may be provisionally calcined after the glass frit applying step and before the alignment step. Alternatively, the calcination of the phosphor material layer may be omitted in the step of forming the phosphor layer, and instead it may be performed together with the calcination of the glass frit.

EXAMPLE

《Confirmatory Test For Variation Range of Discharge Starting Voltage》

Figure 10:
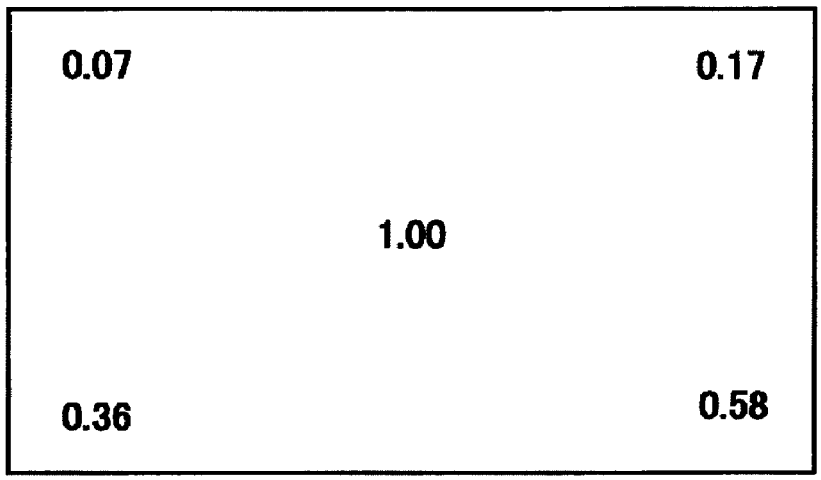
FIG. 10 is a result of Example, showing a variation range of a discharge starting voltage.
Figure 10:
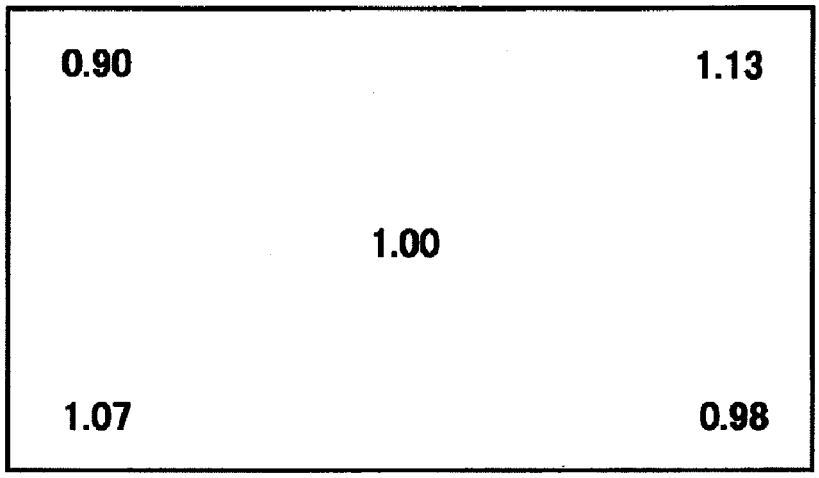

In order to verify the effect of the present invention, distribution regarding the variation range of discharge starting voltage over the panel surface was studied. To this end, the comparative testing was conducted between the prior art and the present invention. Discharge starting voltage $V_{f1}$ at a predetermined position of a panel was measured. Whereas the discharge starting voltage $V_{f2}$ at the same position was measured after keeping the panel turned on continuously for 15 minutes and then letting the substrate temperature decrease to the normal temperature. Variation range was defined as the absolute value of the difference $|V_{f1}-V_{f2}|$. The variation range is an indicator related to the afterimage or image lag characteristic of the PDP, which is desired to be uniform over the panel surface. The results are shown in FIG. 10. FIG. 10(*a*) shows the result of the prior art whereas FIG. 10(*b*) shows the result of the present invention (values shown are relative values of the variation range at the respective positions when the variation range at the center of the panel is normalized to 1.00). It will be noted that the prior art example has such a constitution as a single glass tube is used to supply dry air into the panel, and is used to purge the gas after sealing. As will be apparent from the results shown in FIG. 10, the method of the present invention has a remarkable effect for an improvement of uniformity of the panel surface.

INDUSTRIAL APPLICABILITY

The PDP obtained by the method of the present invention has a satisfactory service life of the panel, and thus it is not only suitable for household use and commercial use, but also suitable for use in other various kinds of display devices.

CROSS REFERENCE TO RELATED PATENT APPLICATION

The disclosure of Japanese Patent Application No. 2008-187404 filed Jul. 18, 2008 including specification, drawings and claims is incorporated herein by reference in its entirety.

What is claimed is:

1. A method for producing a plasma display panel, the method comprising:

forming a front panel and a rear panel, the front panel being formed to include an electrode A, a dielectric layer A and a protective layer formed on a substrate A, and the rear panel being formed to include an electrode B, a dielectric layer B, a partition wall and a phosphor layer formed on a substrate B;

applying a glass frit material onto a peripheral region of one of the substrate A and the substrate B, and subsequently disposing the front panel and the rear panel to oppose one another, such that the applied glass frit material is interposed between the opposing front and rear panels;

supplying, via a gas supply device, a gas into a space formed between the opposing front and rear panels, the gas supply device being in contact with a side of the opposing front and rear panels along an entire length of the side of the panels, such that the supplied gas flows between the opposing front and rear panels mostly in one direction, the gas being supplied while the opposing front and rear panels are heated; and melting the glass frit material, so as to seal the opposing front and rear panels.

2. The method according to claim 1, wherein a principal surface of each of the front and rear panels is square or rectangular in shape, and wherein the gas is supplied wholly from a side of the opposing front and rear panels, such that the side from which the gas is wholly supplied corresponds to one side of the square or rectangular shape of the principal surface of each of the opposing front and rear panels.

3. The method according to claim 1, wherein the gas is supplied through a plurality of supply ports of the gas supply device.

4. The method according to claim 1, wherein the glass frit material is applied intermittently onto the peripheral region of the one of the substrate A and the substrate B.

5. The method according to claim 1, wherein the melting of the glass frit material is performed during the supplying of the gas.

6. The method according to claim 1, wherein a metallic foil is provided in at least a part of a space surrounded by the front panel, the rear panel, the gas supply device and the glass frit material.

7. The method described according to claim 1, wherein the gas is inert to the protective layer, and wherein the gas is at least one kind of gas selected from a group consisting of nitrogen gas, noble gas and dry air.

8. The method according to claim 1, wherein the protective layer is made of at least one kind of metal oxide selected from a group consisting of magnesium oxide, calcium oxide, strontium oxide and barium oxide.

9. The method according to claim 2, wherein the principal surface of each of the front and rear panels is rectangular in shape, and wherein the side from which the gas is wholly supplied corresponds to one long side of the rectangular shape of the principal surface of each of the opposing front and rear panels.

10. The method according to claim 2, wherein a lead wire of the electrode B extends from one side (a) of the opposing front and rear panels, and wherein the gas is supplied from a direction lateral to another side (b) of the opposing front and rear panels, the other side (b) being opposed to the one side (a).

11. The method according to claim 5, wherein the opposing front and rear panels are sealed at the peripheral regions of the substrates A and B as a result of the melting of the glass frit material, so as to cease the supplying of the gas into the space formed between the opposing front and rear panels.

* * * * *